US006748735B2

(12) United States Patent
Schmotolocha et al.

(10) Patent No.: US 6,748,735 B2
(45) Date of Patent: Jun. 15, 2004

(54) TORCH IGNITER

(75) Inventors: Stephen N. Schmotolocha, Thousand Oaks, CA (US); Donald H. Morris, Thousand Oaks, CA (US); Calvin Q. Morrison, Jr., Thousand Oaks, CA (US); Robert J. Pederson, Thousand Oaks, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/217,972

(22) Filed: Aug. 13, 2002

(65) Prior Publication Data

US 2004/0031257 A1 Feb. 19, 2004

(51) Int. Cl.[7] ..... F02C 7/26; F02C 7/264

(52) U.S. Cl. ..... 60/39.826; 60/39.821; 431/158; 431/263; 431/264

(58) Field of Search ..... 60/39.826, 39.827, 60/39.821; 431/158, 263, 264; 239/429, 430, 433

(56) References Cited

U.S. PATENT DOCUMENTS 2,708,341 A * 5/1955 Zucrow ..... 60/39.821
2,832,402 A * 4/1958 Jurisich ..... 60/39.826
2,920,445 A * 1/1960 Bailey ..... 60/39.826
4,343,605 A * 8/1982 Browning ..... 431/158
4,471,732 A 9/1984 Tozzi
4,854,857 A 8/1989 Houtman
4,946,384 A * 8/1990 London ..... 60/39.826
5,085,040 A 2/1992 Tilston
5,257,500 A 11/1993 Venkataramani et al.
5,367,871 A 11/1994 Venkataramani et al.

* cited by examiner

*Primary Examiner*—Ted Kim
(74) *Attorney, Agent, or Firm*—Harness, Dickey & Pierce, P.L.C.

(57) ABSTRACT

An improved torch igniter for use in devices such as thrust augmenters, gas turbine engines, ramjets, combined-cycle engines and industrial burners. The torch igniter includes a housing with a combustion chamber. Fuel and oxidizer are delivered into the combustion chamber and ignited by an electronic ignition source, such as a plasma jet igniter or a spark igniter, so that an upstream recirculation zone and a downstream recirculation zone are created. The upstream recirculation zone stabilizes and pilots combustion within the combustion chamber, while the downstream recirculation zone augments the combustion event. Byproducts of the combustion event within the torch igniter provide a high mass flux with high thermal energy and strong ignition source radicals that are discharged through a neck portion of the housing and are thereafter employed to initiate a primary combustion event in a primary combustor.

20 Claims, 3 Drawing Sheets

TORCH IGNITER

FIELD OF THE INVENTION

The present invention generally relates torch igniters for initiating a combustion event in devices such as industrial burners or combustors for gas turbine engines, ramjets or combined-cycle engines and more particularly to a torch igniter having increased mass flux and energy.

BACKGROUND OF THE INVENTION

Conventional aircraft engines, ramjets, combined-cycle engines and industrial burners typically include an electronically actuated ignition source for initiating a combustion event in a combustion chamber. Such electronically actuated ignition sources are usually of the spark igniter type or the plasma jet type.

Spark igniters typically utilize a spark plug-like device for generating a discharge arc which is employed to generate a flame kernel that ignites a mixture of fuel and oxidizer (e.g., air or oxygen) in the combustion chamber. Plasma jet igniters typically employ a fuel source, such as hydrogen or jet fuel, that dissociates in a spark discharge to produce a kernel of various radicals that in turn initiate a combustion event in the combustion chamber.

If the rate of heat loss from the kernel is less than the rate of heat production in the kernel, the ignition front advances leading to combustor light-off. Most conventional igniters require favorable aerodynamic conditions to advance the ignition front. Some combustors, however, are engineered to operate with inlet conditions (e.g., during supersonic pre-ignition flow) and/or fuel conditions (e.g., fuel type, fuel droplet size, the extent to which the fuel and air have mixed) that do not present the favorable aerodynamic conditions that are necessary for reliable ignition and flame propagation with conventional igniters. Further aggravating this situation, it may not be practical to place the igniter relative to the combustor in the position where it would be most effective as when, for example, the placement of the igniter is dictated by concerns for serviceability or the packaging of the combustor into an application. Accordingly, there remains a need in the art for an improved igniter.

SUMMARY OF THE INVENTION

In one preferred form, the present invention provides a torch igniter having a housing and an electronic ignition source. The housing defines a combustion chamber, at least one fuel conduit and at least one oxidizer conduit. The fuel conduit or conduits intersect the combustion chamber forwardly of an end wall and are configured to dispense at least one stream of fuel into the combustion chamber. The oxidizer conduit or conduits intersect the combustion chamber forwardly of the end wall and are configured to dispense at least one stream of oxidizer into the combustion chamber. The streams of fuel and oxidizer mix to produce a fuel/oxidizer mixture. The fuel and oxidizer conduits are positioned relative to the combustion chamber so as to create an upstream recirculation zone and a downstream recirculation zone that stabilize and pilot combustion within the combustion chamber. The electronic ignition source is coupled to the housing and generates a kernel that is dispensed into the combustion chamber rearwardly of the fuel and oxidizer conduits. The kernel initially ignites the fuel/oxidizer mixture in the recirculation zone, which propagates throughout the combustion chamber.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

Figure 1:
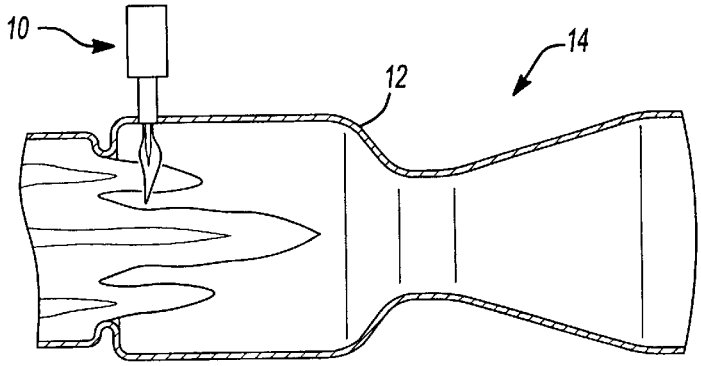
FIG. 1 is a sectional view of a thrust augmenter that includes a torch igniter constructed in accordance with the teachings of the present invention.

With reference to FIG. 1 of the drawings, a torch igniter constructed in accordance with the teachings of the present invention is generally indicated by reference numeral 10. The torch igniter 10 is especially suited to produce a high concentration of free radicals at a high temperature and appropriate mass flux that is required for generating a robust ignition event in the combustor 12 of a device such as a thrust augmenter 14, a turbojet engine, a ramjet engine, a combined-cycle engine or an industrial burner. In the particular embodiment provided, the torch igniter 10 utilizes an ethylene fuel and an air or oxygen oxidizer so as to produce free radicals such as OH, H and O and a robust output torch jet or kernel.

Figures 2, 8:
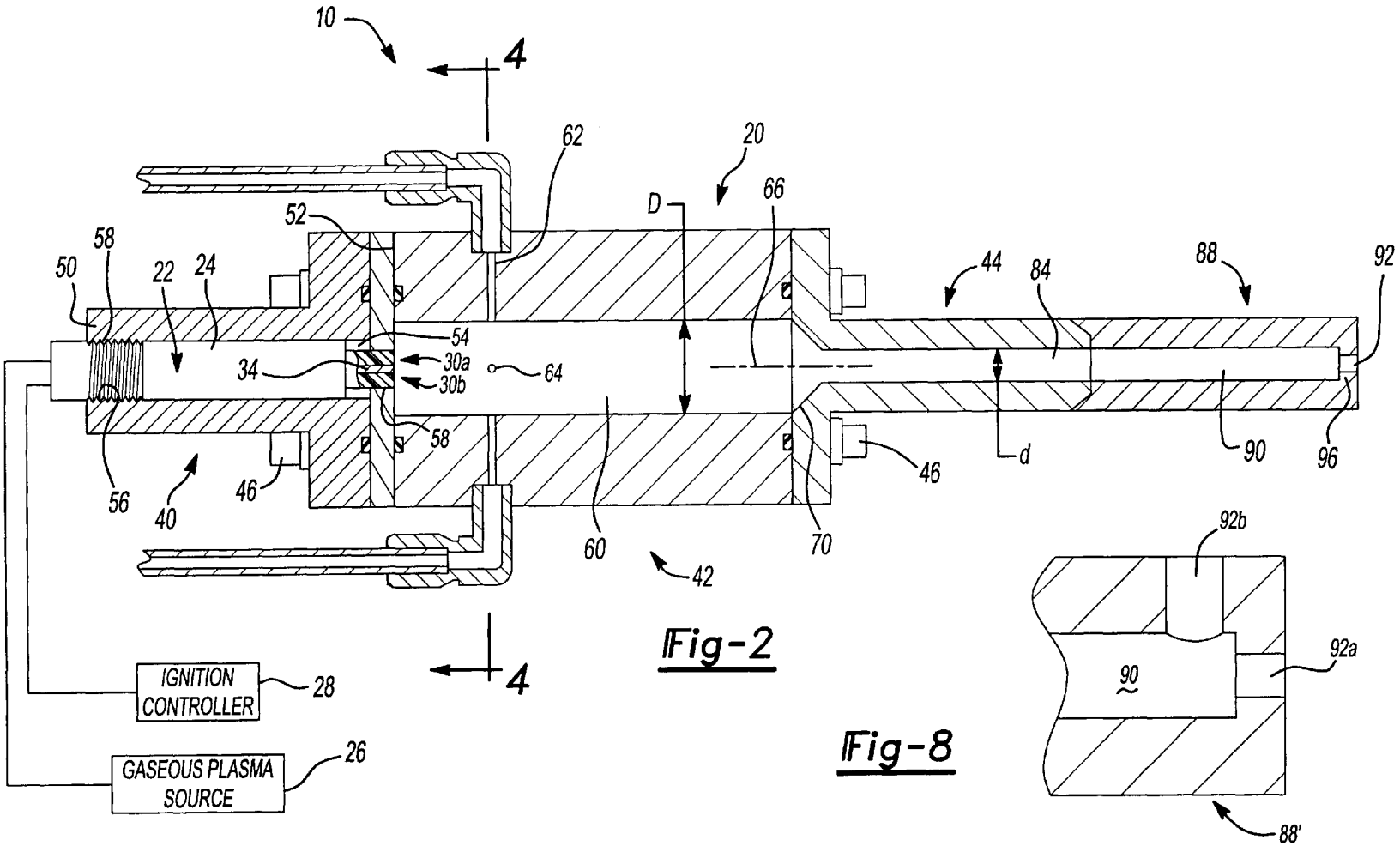
FIG. 2 is a longitudinal section view of the torch igniter of FIG. 1.
FIG. 8 is a sectional view of an alternately constructed tip for the torch igniter of FIG. 1.
Figure 3:
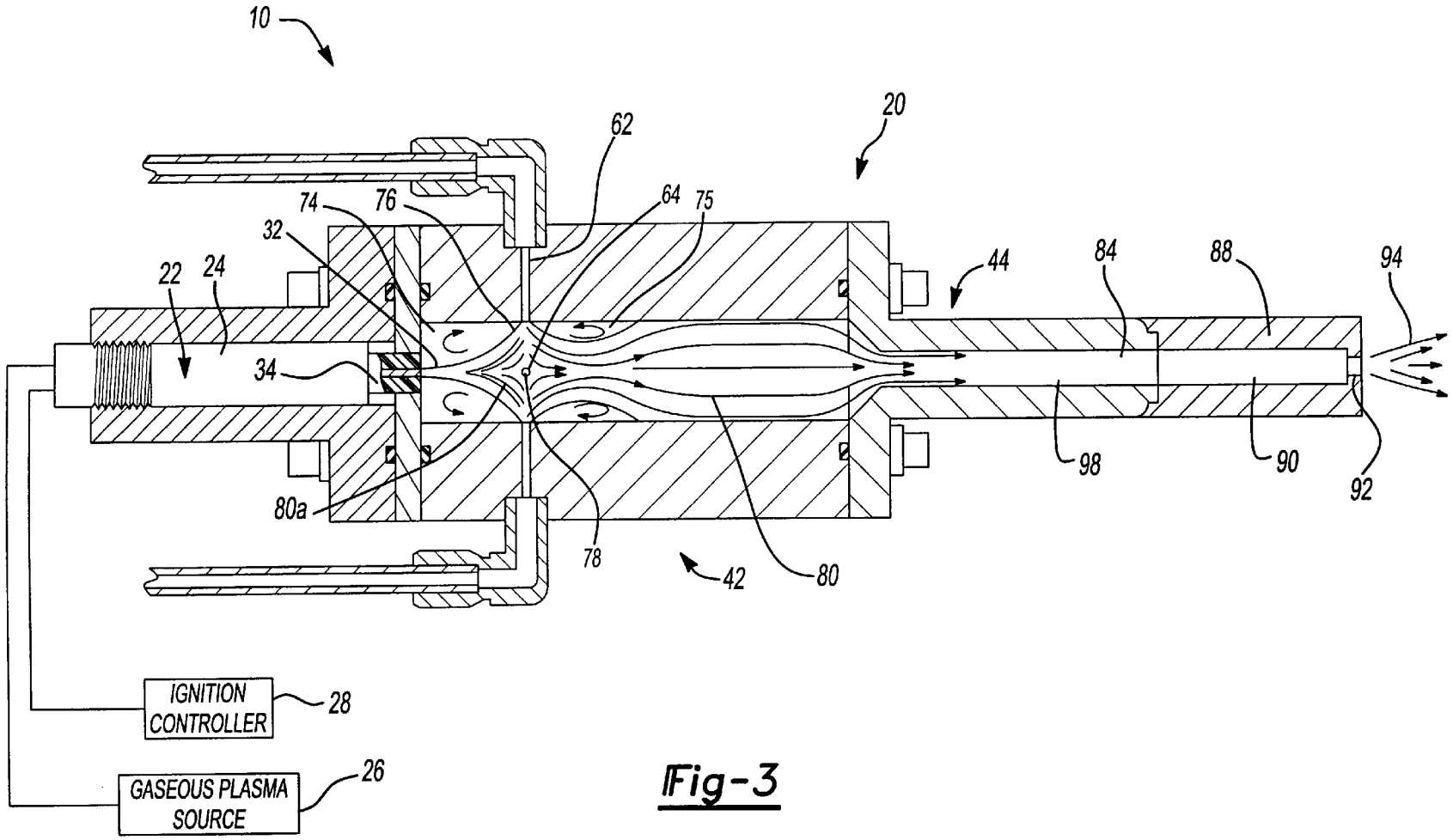
FIG. 3 is a longitudinal section view similar to that of FIG. 2 but illustrating the flow aerodynamics and operation of the torch igniter.

With additional reference to FIGS. 2 and 3, the torch igniter 10 is illustrated to include a housing 20 and an electronic ignition source 22, which is illustrated to be a conventional and commercially available plasma jet igniter 24, such as a plasma jet igniter manufactured by Unison Industries, Jacksonville, Fla. The plasma jet igniter 24 is illustrated to be coupled to a gaseous plasma source 26 and an igniter controller 28. The igniter controller 28 controls the operation of the plasma jet igniter 24 and more specifically, the discharge of electricity across a pair of electrodes 30*a* and 30*b* to dissociate the gaseous plasma source into a plasma jet or kernel 32 that emanates from a tip 34 of plasma jet igniter 24. Alternatively, the electronic ignition source 22 may be a conventional spark igniter, such as a spark igniter manufactured by Champion Spark Plug Company, Toledo, Ohio.

The housing 20 includes an igniter mounting portion 40, a combustion chamber portion 42 and a neck portion 44. In the particular example provided, the igniter mounting portion 40, the combustion chamber portion 42 and the neck portion 44 are separately formed components that are formed from a suitable material, such as 304 stainless or nickel, and fixedly coupled to one another in an appropriate manner, such as with a plurality of threaded fasteners 46 or welds.

The igniter mounting portion 40 includes an annular igniter housing 50 and an end wall 52. The annular igniter housing 50 is removably coupled to the rear side of the combustion chamber portion 42 and defines an igniter aperture 54 that is configured to receive the electronic ignition source 22. In the particular embodiment illustrated, the igniter aperture 54 includes an internally threaded portion 56 that threadably engages an externally threaded portion 58 of the electronic ignition source 22 to permit the electronic ignition source 22 to be fixedly but removably coupled to the igniter mounting portion 40. Those skilled in the art will understand, however, that any known coupling mechanism may be employed to couple the electronic ignition source 22 to the igniter mounting portion 40. The electronic ignition source 22 is disposed in the igniter aperture 54 such that a tip 34 of the electronic ignition source 22 extends at least partially through a tip aperture 58 formed through the end wall 52. As those skilled in the art will appreciate, however, the tip 34 of the electronic ignition source need not extend through the tip aperture 58 in the end wall 52; recessing of the tip 34 inside the end wall 52 is beneficial where enhanced survivability of the electronic ignition source 22 is desired.

The combustion chamber portion 42 defines a combustion chamber 60, at least one fuel conduit 62 and at least one oxidizer conduit 64. The combustion chamber 60 is arranged about the longitudinal axis 66 of the torch igniter 10 and is bounded at its opposite ends by the end wall 52 and a transition wall 70 that abuts the neck portion 44. In the particular example provided, the transition wall 70 is shown to be frustoconically shaped to thereby guide the combustion byproducts into the neck portion 44. Those skilled in the art will appreciate, however, that the transition wall 70 may be shaped in various other manners, including arcuately shaped, or may be omitted altogether such that the neck portion 44 confines the combustion chamber 60 in a manner like that of the end wall 52 (i.e., the neck portion 44 forms a wall that is generally perpendicular to the longitudinal axis of the combustion chamber 60). The fuel and oxidizer conduits 62 and 64 are spaced between the end wall 52 and the neck portion 44 to create an upstream recirculation zone 74 and a downstream recirculation zone 75, both of which being discussed in greater detail, below.

Figure 4:
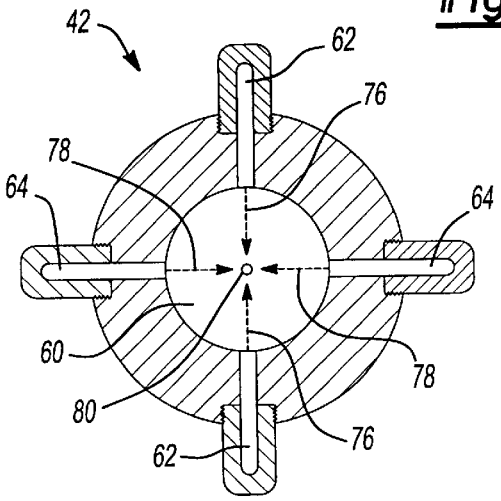
FIG. 4 is a sectional view taken along the line 4—4 of FIG. 2.
Figure 5:
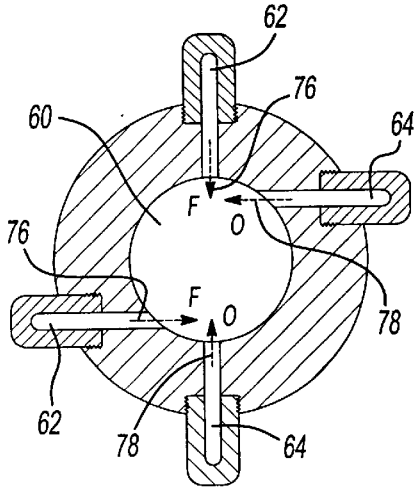
FIG. 5 is a sectional view similar to that of FIG. 4 but illustrating a first alternate arrangement of the fuel and oxidizer conduits.
Figure 6:
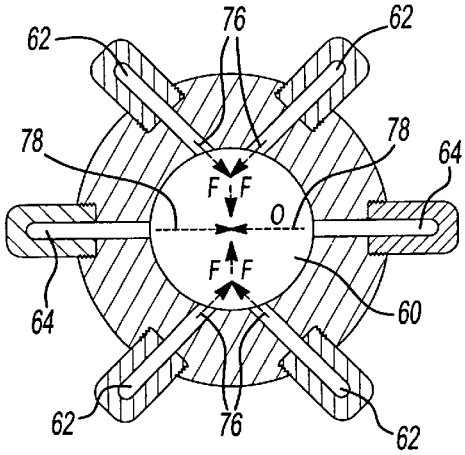
FIG. 6 is a sectional view similar to that of FIG. 4 but illustrating a second alternate arrangement of the fuel and oxidizer conduits.
Figure 7:
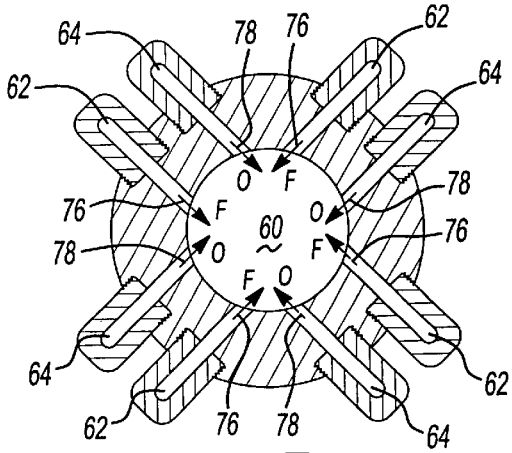
FIG. 7 is a sectional view similar to that of FIG. 4 but illustrating a third alternate arrangement of the fuel and oxidizer conduits.

With additional reference to FIG. 4, the particular example shown includes a combustion chamber portion 42 that defines a pair of fuel conduits 62 which are disposed 180° apart from one another such that the fuel streams 76 produced by the fuel conduits 62 impinge upon one another. Similarly, the particular example provided includes a pair of oxidizer conduits 64 that are disposed 180° apart from one another and offset by 90° from the fuel conduits 62. Accordingly, the oxidizer conduits 64 produce oxidizer streams 78 that impinge upon one another, as well as the fuel streams 76 to thereby produce a fuel/oxidizer mixture 80. Those skilled in the art will understand, however, that the fuel and oxidizer streams 76 and 78 need not impinge upon one another about a common point as is illustrated in FIGS. 5 through 7. The embodiment of FIG. 4 is presently preferred, however, as direct impingement about a common point is somewhat less complicated and therefore more practical.

Returning to FIGS. 2 and 3, the neck portion 44 defines a neck barrel 84 that is in fluid communication with the combustion chamber 60. The neck barrel 84 is illustrated to have diameter d that is about 20% to about 60% of the diameter D of the combustion chamber 60. Accordingly, the neck barrel 84 is formed to have a lateral cross-section that is substantially smaller than the lateral cross-section of the combustion chamber 60. In the particular embodiment provided, the diameter d is about 40% of the diameter D.

In the example shown, the torch igniter 10 is also illustrated to include a tip 88 that is coupled to the neck portion 44 on a side opposite the combustion chamber portion 42. The tip 88 serves to extend the neck portion 44 and may be integrally formed with the neck portion 44 or may be a discrete structure that is coupled, permanently or removably, to the neck portion 44. It is presently preferred that the tip 88 be a discrete structure so as to permit it to be formed from a material, such as 200 nickel, that is more appropriate for the environment in which it will be used.

The tip 88 includes a longitudinally extending and generally cylindrical tip bore 90 and one or more orifices 92, which intersect the tip bore 90 at a distal end of the tip 88. The tip bore 90 is in fluid communication with the combustion chamber 60 and receives therefrom the byproducts of the combustion event in the combustion chamber 60. These byproducts are subsequently expelled from the tip 88 through the orifice 92 as an output kernel 94 that is employed to ignite a recirculation zone. The orifice 92 is illustrated to have an arcuately shaped wall 96 that is disposed concentrically to the tip bore 90, but may also be configured with a generally cylindrical wall. With brief reference to FIG. 8, one or more additional orifices 92 may be utilized to expel additional kernels for igniting the same and/or another recirculation zone. In the embodiment illustrated, the tip 88' includes a first orifice **92*a* that is aligned concentrically to the tip bore 90 and a second orifice 92*b* that is aligned generally perpendicular to the first orifice 92*a***.

Although the tip bore 90 and neck barrel 84 are illustrated to be cylindrically shaped and identically sized, those skilled in the art will appreciate that other configurations are possible. For example, the neck barrel 84 and/or the tip bore 90 may have an arcuate or frustoconical shape. As another example, the tip bore 90 may be sized relatively smaller in diameter than the neck barrel 84.

In FIGS. 3 and 4, the operation of the torch igniter 10 is illustrated. The electronic ignition source 22 is operated to generate an ignition kernel 32 that is dispensed into the combustion chamber 60 rearwardly of the fuel and oxidizer conduits 62 and 64 (i.e., rearwardly of the point at which the fuel and oxidizer conduits 62 and 64 intersect the combustion chamber 60). A fuel and an oxidizer are dispensed into the combustion chamber 60 via the fuel and oxidizer conduits 62 and 64, respectively, and thereafter mix to produce a fuel/oxidizer mixture 80.

While the majority of the fuel/oxidizer mixture 80 moves forwardly in the combustion chamber 60 toward the neck barrel 84, a relatively small portion **80*a* of the fuel/oxidizer mixture 80 is diverted into the portion of the combustion chamber 60 between the end wall 52 and the fuel and oxidizer conduits 62 and 64 and ignited by the ignition kernel 32. The fuel/oxidizer mixture inside the recirculation zone 74 that is ignited by the ignition kernel 32 operates to ignite the fuel/oxidizer mixture 80, which in turn ignites the recirculation zone 75 that together ignite the remainder of the fuel/oxidizer mixture 80 that is disposed forwardly in the combustion chamber 60 and sustain a self-propagating flame. Accordingly, those skilled in the art will appreciate that the fuel and oxidizer conduits 62 and 64 are positioned relative to the combustion chamber 60 to create an upstream recirculation zone 74 and a downstream recirculation zone 75 that cooperate to stabilize and pilot combustion within the combustion chamber 60. In the particular example provided, the streams of fuel and oxidizer 76 and 78 impinge upon one another so as to promote enhanced mixing and atomization of the fuel and oxidizer (when liquid fuel and/or oxidizer is used), which thereby produces a fuel/oxidizer mixture 80 within flammability limits that burns more completely, as well as to more fully control the flow and aerodynamic characteristics of the upstream recirculation zone 74 and downstream recirculation zone 75**.

The byproducts 98 of the combustion event in the combustion chamber 60 are ejected in a jet output kernel 94 that travels through the neck barrel 84 and tip bore 90 and out the orifice 92 in the tip 88. The high-temperature byproducts 98 of the output kernel 94 provide a discharge of high mass flux jet with copious ignition source radicals, such as H, OH and O, and as such, the torch igniter 10 is well suited for use in applications, such as combustors, that lack the favorable aerodynamic conditions that would be necessary to advance the ignition front if a conventional igniter were employed.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A torch igniter comprising:

a housing defining a combustion chamber, at least one fuel conduit and at least one oxidizer conduit, the at least one fuel conduit intersecting the combustion chamber forwardly of an end wall and being configured to dispense at least one stream of fuel into the combustion chamber, the at least one oxidizer conduit intersecting the combustion chamber forwardly of the end wall and being configured to dispense at least one stream of oxidizer into the combustion chamber, the at least one stream of fuel mixing with the at least one stream of oxidizer to produce a fuel/oxidizer mixture; and an electronic ignition source coupled to the housing and generating an ignition kernel that is dispensed into the combustion chamber rearwardly of the fuel and oxidizer conduits, the ignition kernel initially igniting the fuel/oxidizer mixture in the combustion chamber;

wherein the fuel and oxidizer conduits are positioned relative to the combustion chamber to create an upstream recirculation zone and a downstream recirculation zone, the upstream and downstream recirculation zones cooperating to stabilize and pilot combustion within the combustion chamber.

2. The torch igniter of claim 1, wherein the electronic ignition source is selected from a group consisting of plasma jet igniters and spark igniters.

3. The torch igniter of claim 1, wherein each of the fuel conduits is spaced about the combustion chamber between two oxidizer conduits.

4. The torch igniter of claim 1, wherein each of the oxidizer conduits is spaced about the combustion chamber between two fuel conduits.

5. The torch igniter of claim 1, wherein the housing further comprises an ignition source mounting portion that is disposed rearwardly of an end wall of the combustion chamber, the end wall including an aperture into which a tip portion of the electronic ignition source extends, the kernel being ejected through the tip portion.

6. The torch igniter of claim 1, wherein the housing further comprises a neck portion that is disposed on a side of the combustion chamber opposite the electronic ignition source, the neck portion having a neck barrel that is in fluid communication with the combustion chamber, wherein combustion byproducts that are generated from combustion of the fuel/oxidizer mixture in the combustion chamber are discharged through the neck barrel and out of the housing.

7. The torch igniter of claim 6, wherein the housing further comprises a tip that is coupled to the neck portion on a side opposite the combustion chamber, the tip having at least one orifice formed therein, the at least one orifice being in fluid communication with the neck barrel.

8. The torch igniter of claim 7, wherein the tip includes a first orifice and a second orifice, the first orifice being disposed generally perpendicular to the second orifice.

9. The torch igniter of claim 8, wherein the first orifice is disposed substantially coincident along a longitudinal axis of the neck barrel.

10. The torch igniter of claim 7, wherein the tip is fixedly coupled to the neck portion.

11. The torch igniter of claim 1, wherein at least one of the streams of fuel and oxidizer impinges on another one of the streams of fuel and oxidizer.

12. The torch igniter of claim 11, wherein all of the streams of fuel and oxidizer impinge upon one another about a common point.

13. A torch igniter comprising:

a torch housing having an igniter mounting portion, a combustion chamber portion and a neck portion, the igniter mounting portion terminating at an end wall that is located at a first end of the combustion chamber portion, the combustion chamber portion defining a combustion chamber, at least one fuel conduit and at least one oxidizer conduit, each fuel conduit being configured to dispense a stream of fuel into the combustion chamber, each oxidizer conduit being configured to dispense a stream of oxidizer into the combustion chamber, the fuel and oxidizer conduits being spaced between the first end of the combustion chamber portion and a second end of the combustion chamber portion that is opposite the first end, the fuel and oxidizer conduits being positioned relative one another such that the streams of fuel and oxidizer impinge on one another to form a fuel/oxidizer mixture, the neck portion defining a neck barrel that is in fluid communication with the combustion chamber, the neck barrel having a lateral cross-section that is smaller than a lateral cross-section of the combustion chamber; and an electronically actuated ignition source at least partially housed in the igniter mounting portion, the electronically actuated ignition source having a tip portion for generating an ignition kernel in the combustion chamber, the ignition kernel generating a combustion event in which the fuel/oxidizer mixture combusts;

wherein byproducts produced by combustion of the fuel/oxidizer mixture are ejected through the neck barrel.

14. The torch igniter of claim 13, wherein the electronic ignition source is selected from a group consisting of plasma jet igniters and spark igniters.

15. The torch igniter of claim 13, wherein each of the fuel conduits is spaced about the combustion chamber between two oxidizer conduits.

16. The torch igniter of claim 13, wherein each of the oxidizer conduits is spaced about the combustion chamber between two fuel conduits.

17. The torch igniter of claim 13, wherein the housing further comprises a tip that is coupled to the neck portion on a side opposite the combustion chamber, the tip having at least one orifice formed therein, the at least one orifice being in fluid communication with the neck barrel.

18. The torch igniter of claim 17, wherein the tip includes a first orifice and a second orifice, the first orifice being disposed generally perpendicular to the second orifice.

19. The torch igniter of claim 18, wherein the first orifice is disposed substantially coincident a longitudinal axis of the neck barrel.

20. The torch igniter of claim 17, wherein the tip is fixedly coupled to the neck portion.

* * * * *